US011117371B2

(12) United States Patent
Tsuzuki et al.

(10) Patent No.: US 11,117,371 B2
(45) Date of Patent: Sep. 14, 2021

(54) RECORDING SYSTEM

(71) Applicant: SEIKO EPSON CORPORATION, Tokyo (JP)

(72) Inventors: Masakazu Tsuzuki, Shiojiri (JP); Shinichi Tsubota, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/773,152

(22) Filed: Jan. 27, 2020

(65) Prior Publication Data

US 2020/0238694 A1 Jul. 30, 2020

(30) Foreign Application Priority Data

Jan. 30, 2019 (JP) ..... JP2019-014106

(51) Int. Cl.
*B41J 2/045* (2006.01)
*B41J 2/21* (2006.01)

(52) U.S. Cl.
CPC ..... *B41J 2/04588* (2013.01); *B41J 2/04581* (2013.01); *B41J 2/21* (2013.01)

(58) Field of Classification Search
CPC B41J 2/04588; B41J 2/04581; B41J 2/04596; B41J 2/21; B41J 2/2125; B41J 2/2128; B41J 2/04513; B41J 2/04515; B41J 2/04516; B41J 2/04551; B41J 2/0459; B41J 2/04591; B41J 2/04593; B41J 2/04595
See application file for complete search history.

(56) References Cited

U.S. PATENT DOCUMENTS 6,328,395 B1 12/2001 Kitahara et al.
2007/0291065 A1* 12/2007 Shibata ..... B41J 2/2125 347/15
2011/0228023 A1* 9/2011 Ozawa ..... B41J 2/2114 347/98

FOREIGN PATENT DOCUMENTS

JP H10-081012 3/1998
JP 2000-118008 4/2000
JP 2005-001202 1/2005

* cited by examiner

*Primary Examiner* — Kristal Feggins
(74) *Attorney, Agent, or Firm* — Workman Nydegger

(57) ABSTRACT

A recording system records a multi-tone image with liquid droplets of different amount discharged from nozzles. This recording system has a first nozzle and a second nozzle. The minimum amount of a liquid droplet discharged from the first nozzle is larger than the minimum amount of a liquid droplet discharged from the second nozzle.

9 Claims, 10 Drawing Sheets

| TONE VALUE | PULSE SELECTION DATA | P1 | P2 | P3 |
|---|---|---|---|---|
| 0(00) | 000 | OFF | OFF | ON |
| 1(01) | 010 | OFF | ON | OFF |
| 2(10) | 011 | ON | OFF | OFF |

FIG. 11

| CATEGORY | TYPE OF INK | DRIVING PULSE P TO BE USED | DITHER MASK |
|---|---|---|---|
| SECOND INK | LIGHT MAGENTA, LIGHT CYAN, LIGHT BLACK, VIOLET | P1, P2, P3 | SECOND DITHER MASK |
| FIRST INK | CYAN, MAGENTA, YELLOW, BLACK | P2, P3 | FIRST DITHER MASK |

| TONE VALUE | PULSE SELECTION DATA | P1 | P2 | P3 |
|---|---|---|---|---|
| 0(00) | 000 | OFF | OFF | ON |
| 1(01) | 010 | OFF | ON | OFF |
| 2(10) | 010 | OFF | ON | OFF |

FIG. 14

| TONE VALUE | PULSE SELECTION DATA | P1 | P2 | P3 |
|---|---|---|---|---|
| 0 (00) | 000 | OFF | OFF | ON |
| 1 (01) | 010 | OFF | ON | OFF |
| 2 (10) | 000 | OFF | OFF | ON |

FIG. 15

| | P1 | | P2 | |
|---|---|---|---|---|
| | DRIVING PULSE | AMOUNT OF DISCHARGE [pl] | DRIVING PULSE | AMOUNT OF DISCHARGE [pl] |
| FIRST INK | PULSE 1 | 3.0 | PULSE 3 | 4.0 |
| SECOND INK | PULSE 2 | 2.0 | PULSE 3 | 4.0 |

RECORDING SYSTEM

The present application is based on, and claims priority from JP Application Serial Number 2019-014106, filed Jan. 30, 2019, the disclosure of which is hereby incorporated by reference herein in its entirety.

BACKGROUND

1. Technical Field

The present disclosure relates to a technology for a recording system.

2. Related Art

In a technology, known in related art, that performs multi-tone printing in a printer, the amount of an ink droplet to be discharged from a print head is changed to achieve multi-tone printing (see JP-A-10-81012, for example).

When, in the technology in the related art, the amount of a liquid droplet to be discharged from the print head is reduced to improve granularity, much more mist may be generated from liquid droplets. Mist is a substance that has failed to adhere to a recording medium such as print paper and is floating in the printer. When mist is generated and adheres to the print head and other sections of the printer, the printer may become dirty.

SUMMARY

According to an aspect of the present disclosure, a recording system is provided that discharges different amounts of liquid droplets from a single nozzle to achieve multi-tone recording. This recording system has a first nozzle and a second nozzle. The minimum amount of a liquid droplet discharged from the first nozzle is larger than the minimum amount of a liquid droplet discharged from the second nozzle.

BRIEF DESCRIPTION OF THE DRAWINGS

FIG. 11 indicates combinations of types of inks and driving pulses to be used.

FIG. 14 indicates pulse selection data in a third embodiment and driving pulses to be selected.

FIG. 15 indicates driving pulses in a fourth embodiment.

DESCRIPTION OF EXEMPLARY EMBODIMENTS

A. First Embodiment

Figure 1:
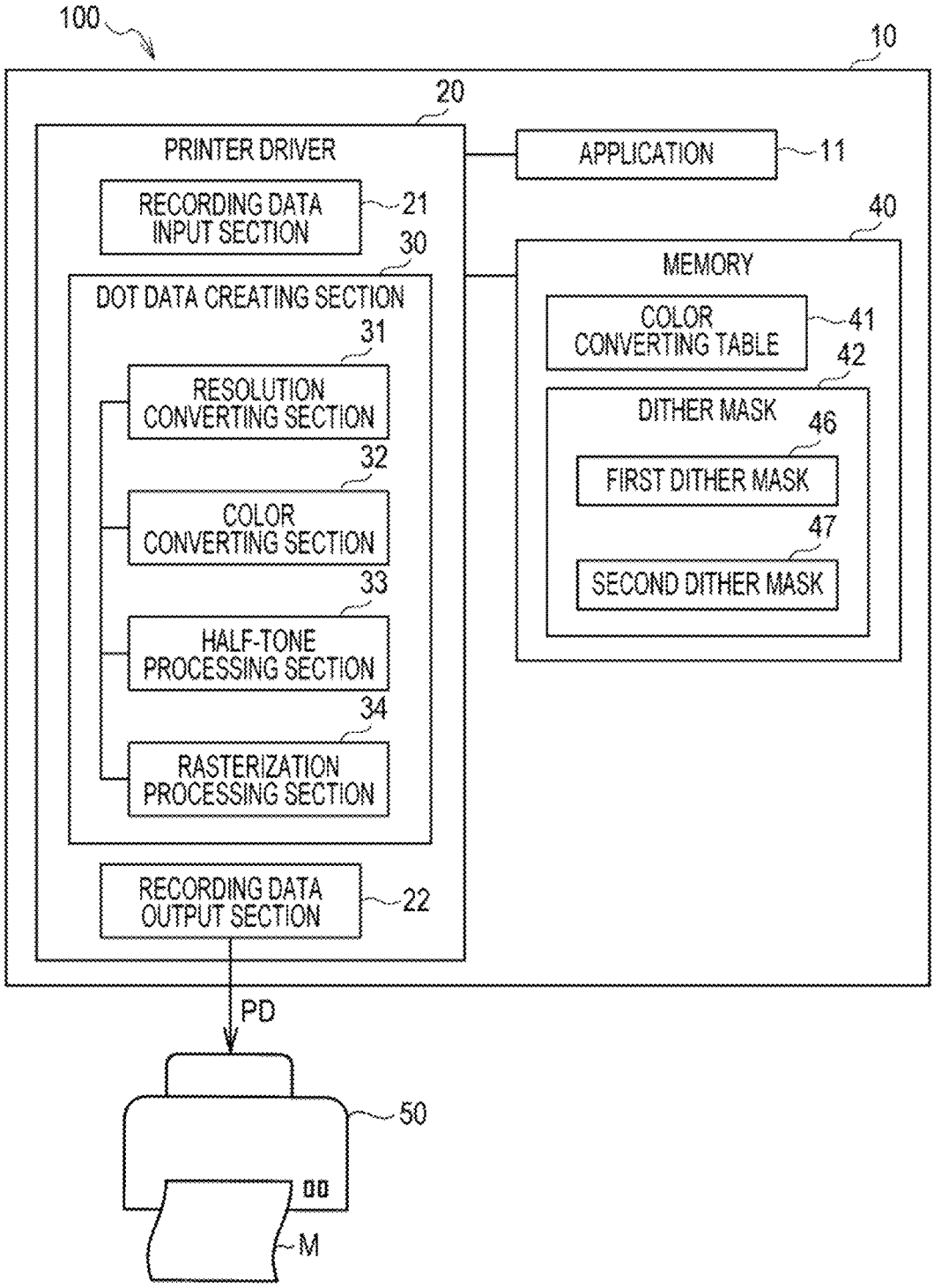
FIG. 1 illustrates a recording system as a first embodiment of the present disclosure.

FIG. 1 illustrates a recording system 100 as a first embodiment of the present disclosure. The recording system 100 lands ink on a medium M such as paper to record an image such as characters. A pigment ink or dye ink, for example, is used as the ink. In this embodiment, a pigment ink is used as the ink. The recording system 100 has an image processing apparatus 10 and a recording apparatus 50. The recording apparatus 50 is an ink jet printer. It uses a cyan ink, magenta ink, yellow ink, black ink, light cyan ink, light magenta ink, light black ink, and violet ink to record an image on the medium M. The recording system 100 can achieve multi-tone recording by discharging different amounts of liquid droplets from a single nozzle, which is, for example, a second nozzle described later.

The image processing apparatus 10 performs image processing to create recording data PD that represents an image to be recorded on the medium M by the recording apparatus 50. The image processing apparatus 10 then sends the created recording data PD to the recording apparatus 50. In this embodiment, the image processing apparatus 10 is structured by a personal computer. The image processing apparatus 10 has an application 11, a printer driver 20, and a memory 40.

The application 11 is implemented when a central processing unit (CPU), which is not illustrated, executes application software prestored in the memory 40. Similarly, the printer driver 20 is implemented when the CPU (not illustrated) executes printer driver software prestored in the memory 40. The printer driver 20 has a recording data input section 21, a dot data creating section 30, and a recording data output section 22. The recording data input section 21 accepts input data such as image data created by the application 11 or image data received from an input interface (not illustrated). In this embodiment, input data is formed from RGB data composed of red, green, and blue color components. In RGB data, each color component is represented by tone value 0 to 255.

The dot data creating section 30 creates recording data PD including dot data that indicates the presence or absence of a dot in each pixel and a dot size. The dot data creating section 30 has a resolution converting section 31, a color converting section 32, a half-tone processing section 33, and a rasterization processing section 34.

The resolution converting section 31 converts the resolution of input data to a resolution used at the time of printing on the medium M. The color converting section 32 converts RGB data, which is input data, to ink color data represented by the tone values of ink colors used in the recording apparatus 50. In this embodiment, the color converting section 32 converts RGB data to ink color data represented by the tone values of cyan, magenta, yellow, black, light cyan, light magenta, light black, and violet. Although, in this embodiment, the range of the tone values of ink color data is 0 to 255, the range is not limited to 0 to 255. Any other range, such as 0 to 128, may be used. In color conversion, the color converting section 32 references a color conversion table 41 prestored in the memory 40.

The half-tone processing section 33 executes half-tone processing. Specifically, the half-tone processing section 33 references a dither mask 42 prestored in the memory 40 and converts the tone values of a 256-level gray scale to tone values composed of two-bit data that can be presented by the recording apparatus 50. In this embodiment, the dither mask 42 includes a first dither mask 46 and a second dither mask 47. The first dither mask 46 is used for data items each of which corresponds to one of the cyan ink, magenta ink, yellow ink, and black ink. The second dither mask 47 is used for data items each of which corresponds to one of the light cyan ink, light magenta ink, light black ink, and violet ink. Half-tone processing may be executed by an error diffusion method or any other method instead of the dither method in which the dither mask 42 is referenced. The rasterization processing section 34 arranges data that indicates the presence or absence of dots and their sizes in the order of pixels in which a recording head 63, which will be described later, performs main scanning. The recording data output section 22 transmits, to the recording apparatus 50, recording data PD, including dot data, that has been created by the dot data creating section 30.

Figure 2:
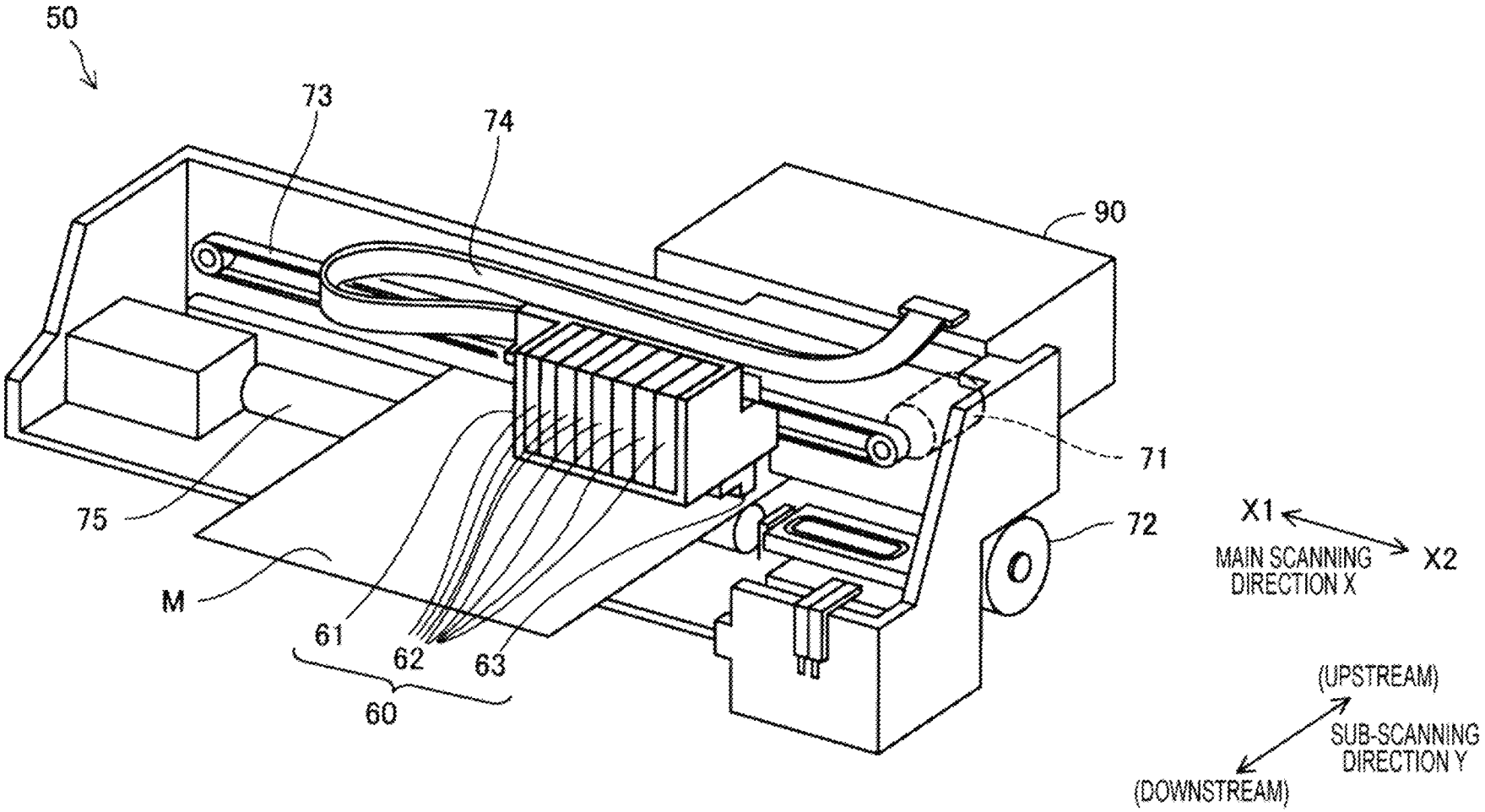
FIG. 2 schematically illustrates the structure of a recording apparatus.
Figure 3:
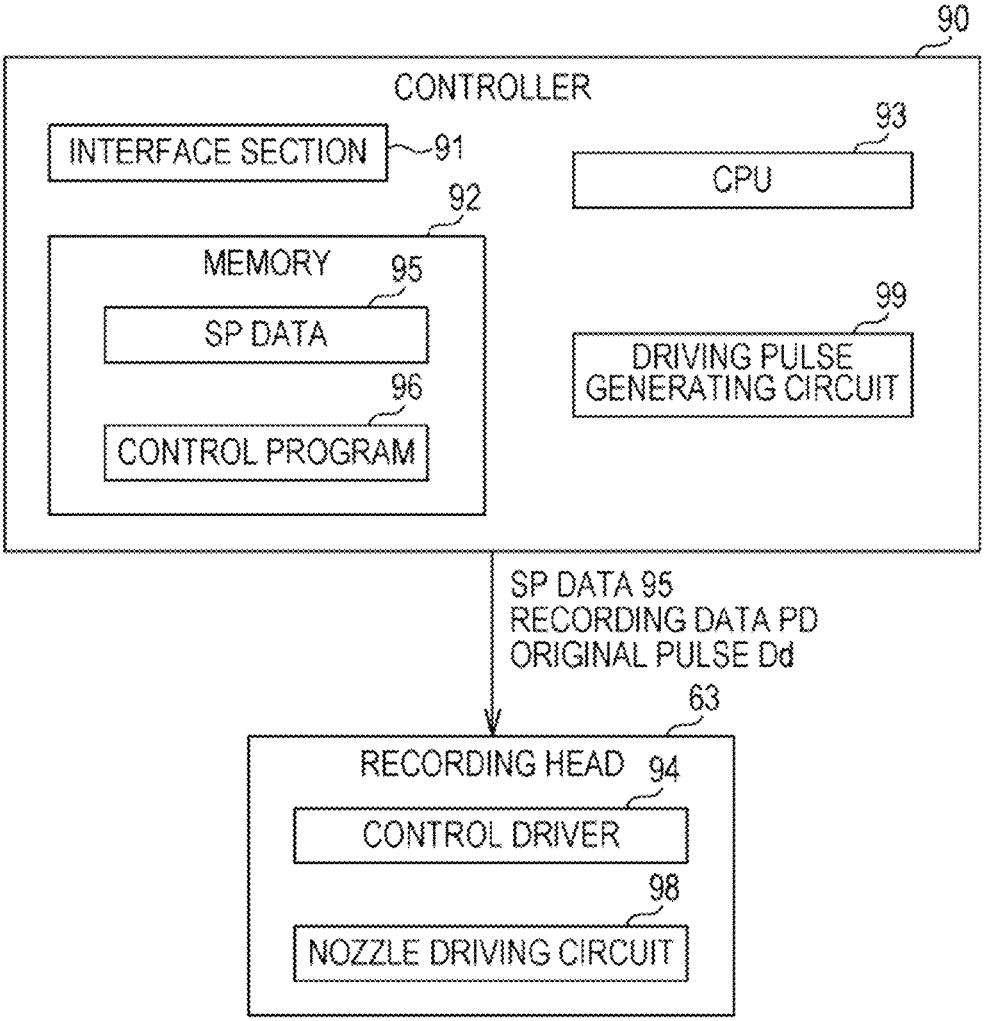
FIG. 3 is an internal block diagram for a controller and a control driver.
Figure 4:
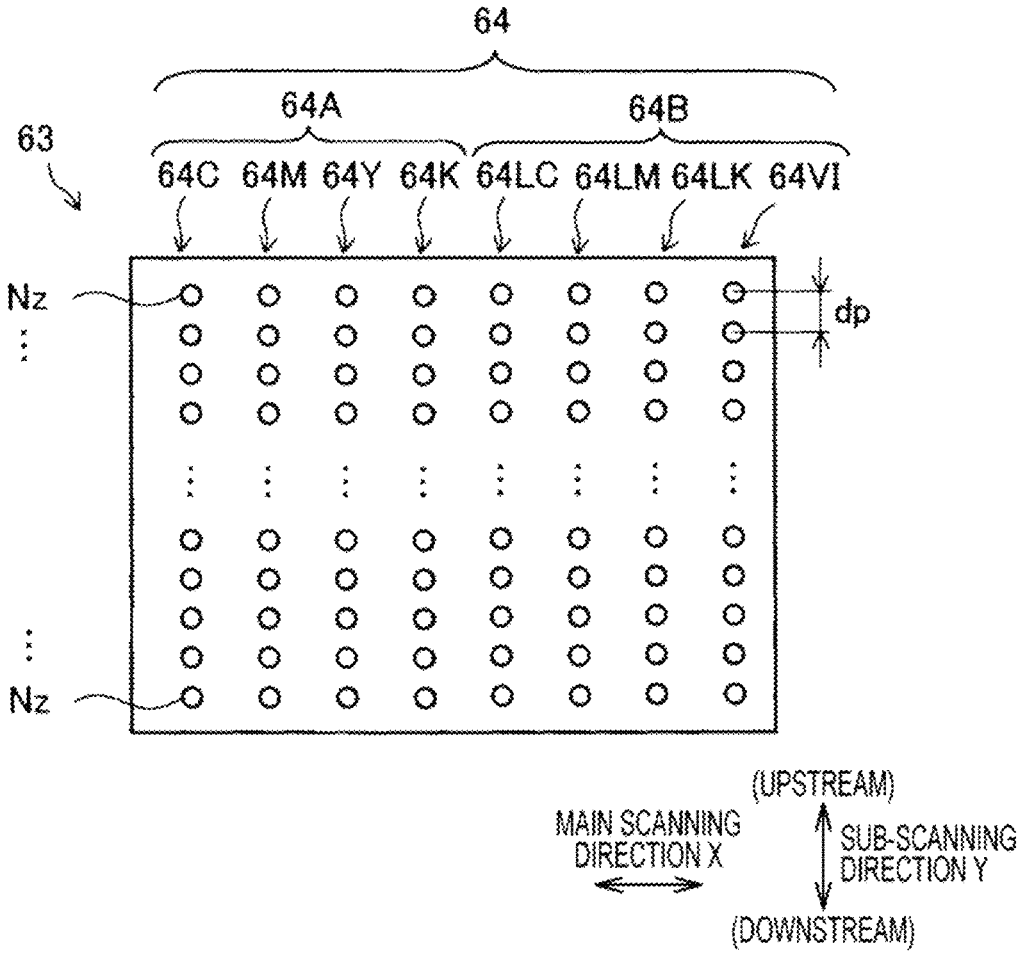
FIG. 4 schematically illustrates the structure of a recording head.

FIG. 2 schematically illustrates the structure of the recording apparatus 50. FIG. 3 is an internal block diagram for a controller 90 and a control driver 94. FIG. 4 schematically illustrates the structure of the recording head 63. In FIG. 4, the structure of the recording head 63 is viewed from the same side as the medium M. The recording apparatus 50 is structured as a so-called serial ink jet printer. During printing, the recording apparatus 50 forms dots on the medium M by discharging liquid droplets of ink according to recording data PD received from the image processing apparatus 10.

As illustrated in FIG. 2, the recording apparatus 50 has a head unit 60, a carriage motor 71, a transport motor 72, a driving belt 73, a flexible cable 74, a platen 75, and the controller 90.

The head unit 60 is electrically coupled to the controller 90 through the flexible cable 74. The head unit 60 is attached to a carriage guide (not illustrated) so as to be bidirectionally movable in a main scanning direction X. The head unit 60 bidirectionally moves along the main scanning direction X due to the power of the carriage motor 71, the power being transmitted through the driving belt 73.

The head unit 60 has a carriage 61 and the recording head 63. Eight ink cartridges 62 are mounted in the carriage 61, one for each ink color. In this embodiment, a cyan ink, magenta ink, yellow ink, black ink, light cyan ink, light magenta ink, light black ink, and violet ink are held in the eight ink cartridges 62. While bidirectionally moving in the main scanning direction X, the recording head 63, which is mounted on the carriage 61, discharges inks to the medium M to form a raster, which is dot rows in the main scanning direction X. The movement of the recording head 63 in the main scanning direction X is also referred to as main scanning. The main scanning direction X includes a first main scanning direction X1 and a second main scanning direction X2 opposite to the first main scanning direction X1. Therefore, the recording head 63 executes first main scanning in the first main scanning direction X1 and second main scanning in the second main scanning direction X2. In this embodiment, the recording head 63 executes so-called single-path printing in which a raster is printed in one main scanning.

As illustrated in FIG. 4, the recording head 63 has eight nozzle rows 64, from which inks in different colors are discharged. Some of the nozzle rows 64 are a nozzle row 64C from which a cyan ink is discharged, a nozzle row 64M from which a magenta ink is discharged, a nozzle row 64Y from which a yellow ink is discharged, and a nozzle row 64K from which a black ink is discharged. The other of the nozzle rows 64 are a nozzle row 64LC from which a light cyan ink is discharged, a nozzle row 64LM from which a light magenta ink is discharged, a nozzle row 64LK from which a light black ink is discharged, and a nozzle row 64V1 from which a violet ink is discharged. These eight nozzle rows, denoted 64C, 64M, 64Y, 64K, 64LC, 64LM, 64LK and 64V1, are arranged in parallel to one another in a sub-scanning direction Y at intervals of a predetermined length. Each of the nozzle rows 64C, 64M, 64Y, 64K, 64LC, 64LM, 64LK and, 64V1 is composed of a plurality of nozzles Nz arranged at a predetermined nozzle pitch dp in the sub-scanning direction Y. The plurality of nozzles Nz constituting each of the nozzle rows 64C, 64M, 64Y, 64K, 64LC, 64LM, 64LK, and 64VI is the same number of nozzles Nz. The nozzles Nz included in each of the nozzle rows 64C, 64M, 64Y, 64K, 64LC, 64LM, 64LK, and 64VI have the same nozzle diameter. A pressure chamber and a piezoelectric element, which are not illustrated, are provided for each nozzle Nz. When the piezoelectric element is driven, the pressure chamber is contracted or expanded, causing liquid droplets to be discharged from the relevant nozzle Nz. The discharged liquid droplets land on the medium M. The piezoelectric element is driven when a driving pulse, which is a predetermined driving signal, is applied across the electrodes of the piezoelectric element by the control driver 94. The driving pulse will be described later in detail.

In the recording head 63, each nozzle Nz included in each of the nozzle rows 64C, 64M, 64Y, and 64K is also referred to as the first nozzle 64A, and each nozzle Nz included in each of the nozzle rows 64LC, 64LM, 64LK and, 64VI is also referred to as the second nozzle 64B. The first nozzle 64A is controlled so that the minimum amount of a liquid droplet dischargeable from the first nozzle 64A is larger than from the second nozzle 64B, as will be described later. In the present disclosure, a relationship in magnitude between the amount of a liquid droplet discharged from the first nozzle 64A and the amount of a liquid droplet discharged from the second nozzle 64B is based on a comparison of an averages for the nozzle rows 64 constituted by the first nozzles 64A and an average for the nozzle rows 64 constituted by the second nozzles 64B, that is, averages for a plurality of nozzles Nz constituting the nozzle rows 64.

The transport motor 72 illustrated in FIG. 2 is driven in response to a control signal from the controller 90. When the power of the transport motor 72 is transmitted to the platen 75, the medium M is transported from the upstream in the sub-scanning direction Y toward the downstream. Although, in this embodiment, the sub-scanning direction Y is orthogonal to the main scanning direction X, this is not a limitation. The main scanning direction X and sub-scanning direction Y may cross each other at an arbitrary angle.

The controller 90 controls the whole of the recording apparatus 50. When recording data PD is output from the image processing apparatus 10, the controller 90 drives the transport motor 72 to have the medium M transported to a recording start position in the sub-scanning direction Y. The controller 90 drives the carriage motor 71 to have the head unit 60 moved to a recording start position in the main scanning direction X. The controller 90 alternately repeats control to have the head unit 60 bidirectionally moved along the main scanning direction X and to have the recording head 63 discharge ink to the medium M under control of the control driver 94 and control for the transport motor 72 to transport the medium M from the upstream toward the downstream in the sub-scanning direction Y. Thus, an image is printed on the medium M.

As illustrated in FIG. 3, the controller 90 has an interface section 91, a memory 92, a CPU 93, and a driving pulse generating circuit 99. The interface section 91 transmits and receives data to and from the image processing apparatus 10. The memory 92 includes a random-access memory (RAM), a read-only memory (ROM), an electrically erasable programmable ROM (EEPROM), and other recording medium. The memory 92 stores SP data 95 and a control program 96. The CPU 93 loads the control program 96 and executes it to control individual sections of the recording apparatus 50.

The SP data 95 is a table in which tone values in the recording data PD and driving pulses to be applied to the piezoelectric elements in the recording head 63. The SP data 95 is serially transferred to the nozzle driving circuit 98.

The driving pulse generating circuit 99 generates an original pulse Dd and transmits it to the nozzle driving circuit 98, which will be described later. The original pulse Dd is a signal used in common by all nozzles Nz.

The control driver 94, which is disposed in the recording head 63, controls the discharging of liquid droplets from the first nozzles 64A and second nozzles 64B according to the recording data PD. The control driver 94 has a nozzle driving circuit 98. The nozzle driving circuit 98 creates pulse selection data Dps with reference to tone values in the recording data PD and the SP data 95. The pulse selection data Dps is signal data used to select a driving pulse to be applied to the piezoelectric elements in the recording head 63. According to the pulse selection data Dps, the nozzle driving circuit 98 selects, from the original pulse Dd, a driving pulse to be applied to the piezoelectric elements. That is, the nozzle driving circuit 98 has a switch circuit that selectively enables and disables the supply of a driving pulse to the piezoelectric elements. The nozzle driving circuit 98 selectively turns on and off the switch circuit according to the pulse selection data Dps. With the switch circuit turned on, a driving pulse is applied to the piezoelectric elements. With the switch circuit turned off, no driving pulse is applied to the piezoelectric elements. When the piezoelectric elements are driven according to the driving pulse applied by the nozzle driving circuit 98, each piezoelectric element causes its corresponding nozzle Nz to discharge liquid droplets by an amount matching the driving pulse.

Figures 5, 6:
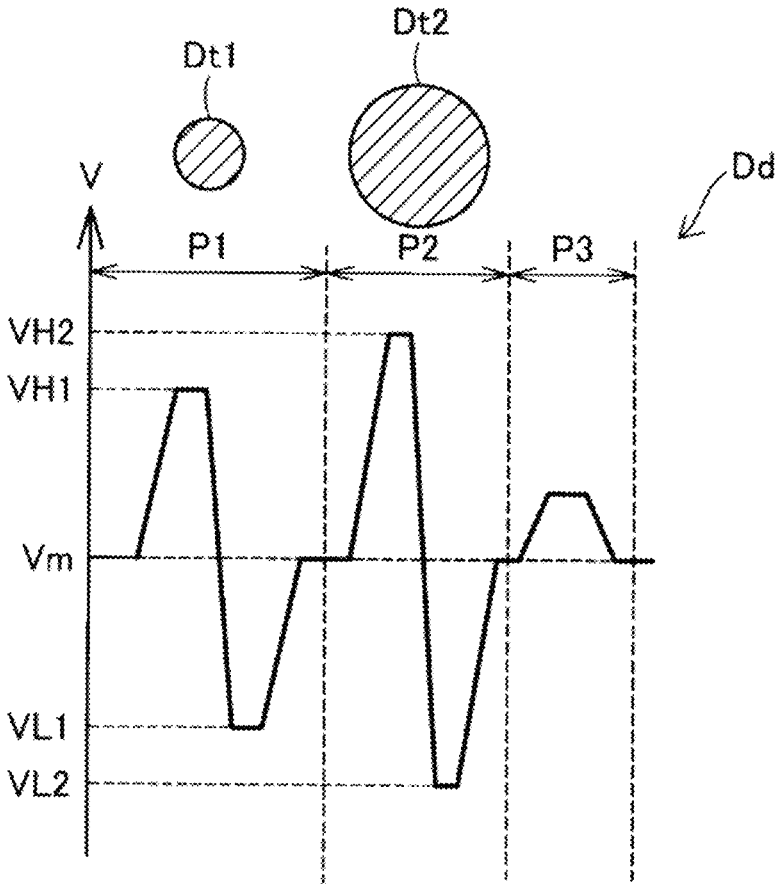
FIG. 5 illustrates an original pulse created by a driving pulse generating circuit.
FIG. 6 indicates pulse selection data and driving pulses to be selected.

FIG. 5 illustrates the original pulse Dd created by the driving pulse generating circuit 99. The original pulse Dd is output to the nozzle driving circuit 98 for each pixel segment, that is, each time the recording head 63 passes a spacing between pixels. The original pulse Dd includes a first pulse P1, a second pulse P2, and a third pulse P3. The first pulse P1 and second pulse P2 have different waveforms, so they cause the piezoelectric element to operate differently. Thus, the amount of a liquid droplet discharged from the nozzle Nz differs between the first pulse P1 and the second pulse P2. Specifically, the first pulse P1 and second pulse P2 are set so that the amount of a liquid droplet discharged from the nozzle Nz according to the second pulse P2 is larger than the amount of a liquid droplet discharged according to the first pulse P1. In this embodiment, the difference between the maximum potential VH2 and minimum potential VL2 of the second pulse P2 is larger than the difference between the maximum potential VH1 and minimum potential VL1 of the first pulse P1, for example. Intermediate potentials Vm of the first pulse P1 and second pulse P2 are set to the same value.

The first pulse P1 is used to discharge a first amount of a liquid droplet from the nozzle Nz. The second pulse P2 is used to discharge a second amount of a liquid droplet, the second amount being larger than the first amount, from the nozzle Nz. In this embodiment, the first amount is 2.0 pico liters (pl) or less, and the second amount is more than 2.0 pl. For example, the first amount is in the range of 1.0 pl to 2.0 pl, and the second amount is in the range of more than 2.0 pl to 5.0 pl. The third pulse P3 causes the meniscus of ink in the nozzle Nz to undergo fine vibration. That is, the third pulse P3 drives the piezoelectric element to the extent that ink is not discharged from the nozzle Nz so that an ink flow occurs in the pressure chamber, the volume of which is changed by the piezoelectric element, and ink in the vicinity of the front surface of the nozzle Nz and ink in the nozzle Nz are thereby exchanged. When the piezoelectric element is driven by the third pulse P3 and ink in the vicinity of the front surface of the nozzle Nz and ink in the nozzle Nz are thereby exchanged, for example, an increase in the viscosity of ink in the nozzle Nz is suppressed.

When the first amount of a liquid droplet is discharged from the nozzle Nz, a first dot Dt1 is formed on the medium M. When the second amount of a liquid droplet is discharged from the nozzle Nz, a second dot Dt2, which has a larger size than the first dot Dt1, is formed on the medium M.

FIG. 6 indicates pulse selection data Dps created according to tone values and the driving pulses P1 to P3 to be selected. The tone value of each pixel in the recording data PD is presented by two bits; for example, tone value 0 is represented as 00, tone value 1 is represented as 01, and tone value 2 is represented as 10.

When tone value 0 is used, pulse selection data Dps (000), which is used to have a meniscus undergo fine vibration without a liquid droplet being discharged from the nozzle Nz, is created. That is, the nozzle driving circuit 98 selects the third pulse P3 from the original pulse Dd according to pulse selection data Dps (000) and supplies the third pulse P3 to the corresponding nozzle Nz. When tone value 1 is used, pulse selection data Dps (010), which is used to discharge the second amount of a liquid droplet from the nozzle Nz, is created. That is, the nozzle driving circuit 98 selects the second pulse P2 from the original pulse Dd according to pulse selection data Dps (010) and supplies the second pulse P2 to the corresponding nozzle Nz. When tone value 2 is used, pulse selection data Dps (011), which is used to discharge the first amount of a liquid droplet from the nozzle Nz, is created. That is, the nozzle driving circuit 98 selects the first pulse P1 from the original pulse Dd according to pulse selection data Dps (011) and supplies the first pulse P1 to the corresponding nozzle Nz.

In the recording system 100 in this embodiment, recording data PD is created so that the first pulse P1 is not selected for the piezoelectric elements used to discharge a cyan ink, magenta ink, yellow ink, and black ink but only either of the second pulse P2 and third pulse P3 is selected for these piezoelectric elements, as will be described later. The cyan ink, magenta ink, yellow ink, and black ink are deep-color inks. Also, in the recording system 100 in this embodiment, recording data PD is created so that any one of the first pulse P1, second pulse P2, and third pulse P3 is selected for the piezoelectric elements used to discharge a light cyan ink, light magenta ink, light black ink, and violet ink. The light cyan ink, light magenta ink, light black ink, and violet ink are light-color inks having a lower content percentage of pigments, which are a solid content, and a lower ink concentration than the deep-color inks. The violet ink is a spot-color ink having a color other than so-called process colors, which are magenta, cyan, yellow, and black constituting the basic colors in the color recording field. This type of spot-color ink is often used to reproduce a color gamut that is difficult to reproduce from a combination of only process colors.

Figure 7:
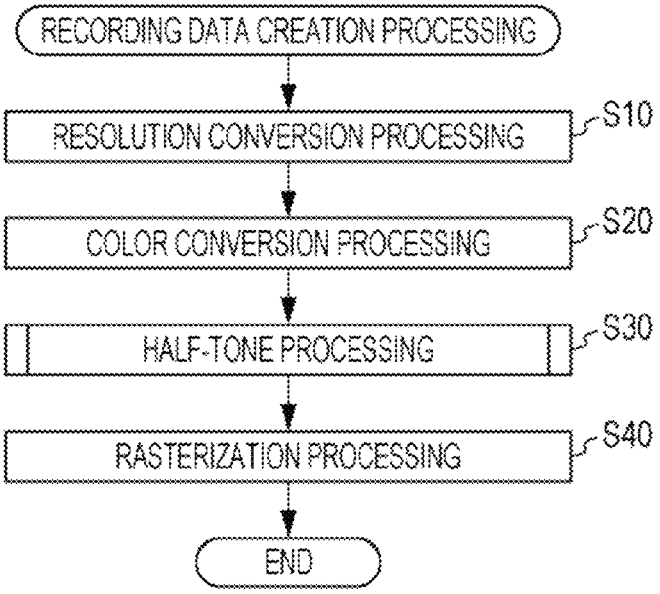
FIG. 7 is a flowchart illustrating recording data creation processing.

FIG. 7 is a flowchart illustrating processing to create recording data PD. When the user issues, on the image processing apparatus 10, a print command in which an image to be obtained by printing is specified, recording data creation processing is started by the image processing apparatus 10.

First, in step S10, the resolution converting section 31 accepts image data and executes resolution conversion processing on the image data. In resolution conversion processing, resolution in the accepted image data is converted to print resolution used at the time of printing on the medium M to create resolution conversion data. Next, in step S20, the color converting section 32 executes color conversion processing on the resolution conversion data. In color conversion processing, the resolution conversion data, which is RGB data, is converted to ink color data used in the recording apparatus 50. Next, in step S30, the half-tone processing section 33 executes half-tone processing on the ink color data. In half-tone processing, ink color data represented by a 256-level gray scale is converted to two-bit data indicating a tone value that can be represented by the recording apparatus 50 to create half-tone data. Next, in step S40, the rasterization processing section 34 executes rasterization processing on the half-tone data.

Figure 8:
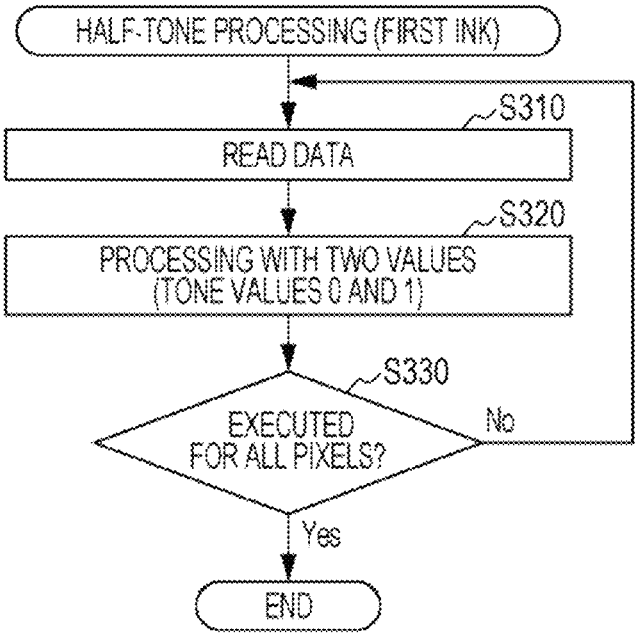
FIG. 8 is a flowchart illustrating a first example of half-tone processing.

FIG. 8 is a flowchart illustrating a first example of half-tone processing. Specifically, FIG. 8 illustrates details of half-tone processing executed by the half-tone processing section 33 for data corresponding to deep-color inks classified as first inks, that is, a cyan ink, magenta ink, yellow ink, and black ink. First, in step S310, the half-tone processing section 33 reads, from the memory 40, data resulting from color conversion processing. Next, in step S320, the half-tone processing section 33 uses the first dither mask 46 to execute half-tone processing with two values, tone values 0 and 1. Next, in step S330, the half-tone processing section 33 decides whether step S320 has been executed for all pixels corresponding to the cyan ink, magenta ink, yellow ink, and black ink. When the decision result in step S320 is No, the half-tone processing section 33 executes step S310 again. When the decision result in step S320 is Yes, the processing in the flowchart is terminated.

Figure 9:
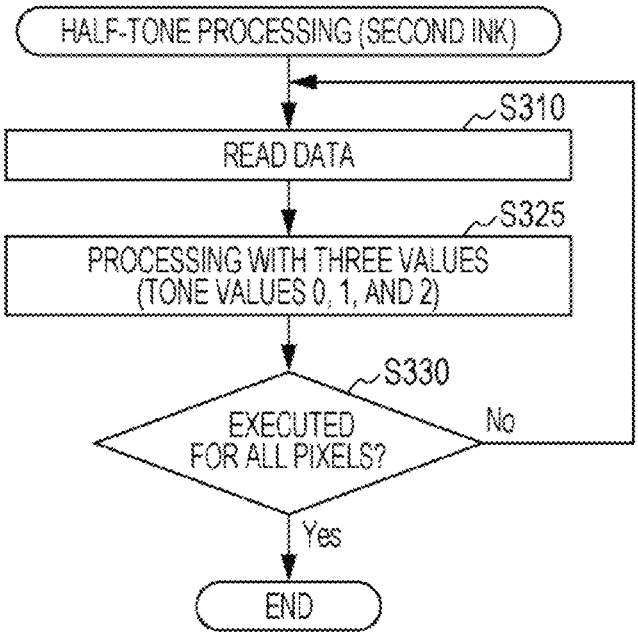
FIG. 9 is a flowchart illustrating a second example of half-tone processing.

FIG. 9 is a flowchart illustrating a second example of half-tone processing. Specifically, FIG. 9 illustrates details of half-tone processing executed by the half-tone processing section 33 for data corresponding to light-color inks and a spot-color ink classified as second inks, that is, a light cyan ink, light magenta ink, light black ink, and violet ink. The flowchart in FIG. 9 differs from the flowchart in FIG. 8 in that step S325 is executed instead of step S320. The other steps are the same as in FIG. 8, so these steps are assigned the same step numbers and descriptions will be omitted. In step S325, the half-tone processing section 33 uses the second dither mask 47 to execute half-tone processing with three values, tone values 0, 1, and 2.

Figure 10:
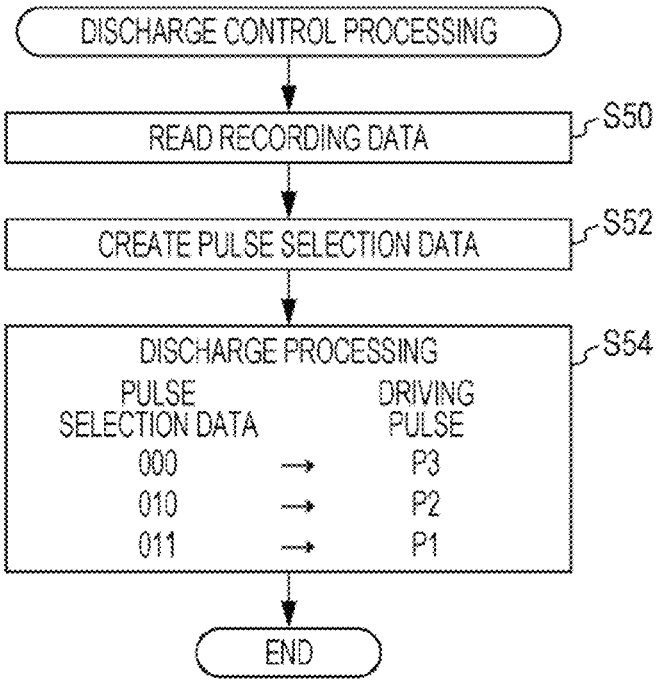
FIG. 10 is a flowchart of discharge control processing executed by the control driver.

FIG. 10 is a flowchart of discharge control processing executed by the control driver 94. In step S50, the control driver 94 reads recording data PD created by the image processing apparatus 10. Next, in step S52, the control driver 94 creates pulse selection data Dps from tone value data included in the recording data PD and SP data 95. Next, in step S54, the control driver 94 executes discharge processing by selectively turning on and off the switch circuit according to the created pulse selection data Dps to apply, to the piezoelectric elements, a driving pulse at a time when the switch circuit is turned on.

As described above, data corresponding to a cyan ink, magenta ink, yellow ink, and black ink classified as the first inks undergoes half-tone processing with tone values of 0 and 1. For a cyan ink, magenta ink, yellow ink, and black ink classified as the first inks, therefore, the control driver 94 can create two pulse selection data items Dps, pulse selection data Dps (010) used to select the second pulse P2 and pulse selection data Dps (000) used to select the third pulse P3, without having to create pulse selection data Dps (011) used to select the first pulse P1. That is, the minimum amount of a liquid droplet discharged from each first nozzle 64A illustrated in FIG. 4 is the second amount corresponding to the second pulse P2.

Data corresponding to a light cyan ink, light magenta ink, light black ink, and violet ink classified as the second inks undergoes half-tone processing with tone values of 0, 1, and 2. For a light cyan ink, light magenta ink, light black ink, and violet ink classified as the second inks, therefore, the control driver 94 can create three pulse selection data items Dps, pulse selection data Dps (010) used to select the first pulse P1, pulse selection data Dps (011) used to select the second pulse P2, and pulse selection data Dps (000) used to select the third pulse P3. That is, the minimum amount of a liquid droplet discharged from each second nozzle 64B illustrated in FIG. 4 is the first amount corresponding to the first pulse P1. Accordingly, the minimum dot that can be formed on the medium M by the first nozzle 64A has a larger diameter than the minimum dot that can be formed on the medium M by the second nozzle 64B.

According to the above first embodiment, the minimum amount of a liquid droplet discharged from the first nozzle 64A is the second amount, and the minimum amount of a liquid droplet discharged from the second nozzle 64B is the first amount. The second amount is larger than the first amount. Thus, when an ink type is appropriately selected according to the nozzle, first nozzle 64A or second nozzle 64B, from which the ink is to be discharged, it is possible to reduce the amount of mist generated from liquid droplets and to suppress a drop in granularity as much as possible. Specifically, in this embodiment, the first nozzle 64A, the minimum amount of a liquid droplet discharged from the first nozzle 64A being large, is used to discharge a deep-color ink having a higher content percentage of pigments, which are a solid content, and the second nozzle 64B, the minimum amount of a liquid droplet discharged from the second nozzle 64B being smaller than from the first nozzle 64A, is used to discharge a light-color ink having a low content percentage of pigments or a spot-color ink. When nozzles Nz from which the first amount of a liquid droplet, the first amount being a small minimum amount, can be discharged are restricted, that is, when the first amount of a liquid droplet can be discharged only from the second nozzles 64B, the amount of generated mist can be reduced. This can suppress a discharge failure due to the adhesion of mist to nozzles Nz. When the second nozzle 64B, which discharges a light-color ink or highly colored ink, discharges a small amount of a liquid droplet, a drop in granularity can be suppressed, making it possible to suppress a drop in image quality.

A nozzle Nz from which a small amount of a liquid droplet is discharged is more likely to be affected by an increase in the viscosity of ink, the increase being caused along with the evaporation of moisture, than a nozzle Nz from which a large amount of a liquid droplet is discharged even when the same type of ink is discharged from these nozzles Nz. In view of this, flushing needs to be performed for the nozzle Nz from which a small amount of a liquid droplet is discharged much more times than for the nozzle Nz from which a large amount of a liquid droplet is discharged. Flushing is processing to discharge viscous ink from the nozzle Nz besides discharging during print operation. Deep-color inks having a high content percentage of pigments such as a cyan ink, magenta ink, yellow ink, and black ink are more likely to be affected by an increase in the viscosity of ink than light-color inks. This leads to the risk that flushing needs to be more often performed for deep-color inks. In this embodiment, however, the number of flushings can be reduced by assigning a deep-color ink a nozzle Nz from which a large amount of a liquid droplet is discharged to reduce the effect of an increase in the viscosity of ink. Therefore, the amount of ink discharged from the first nozzle 64A due to flushing can be reduced. That is, to reduce the amount of ink discharged from the first nozzle 64A due to flushing, the recording system 100 is structured so that, for example, when inks in one type of color, that is, inks in the same color in which the same color material is used, are used as a first ink, which is a deep-color ink having a high ink concentration, and a second ink, which is a light-color ink having a low ink concentration, the first nozzle 64A discharges the first ink and the second nozzle 64B discharges the second ink.

According to the above first embodiment, the second pulse P2 and first pulse P1 have different driving waveforms, the second pulse P2 being a driving pulse for use for the first nozzle 64A to discharge the minimum amount of a liquid droplet from the first nozzle 64A, the first pulse P1 being a driving pulse for use for the second nozzle 64B to discharge the minimum amount of a liquid droplet from the second nozzle 64B. When different driving pulses are used to discharge the minimum amount of a liquid droplet from the first nozzle 64A and from the second nozzle 64B in this way, it is possible to easily make the minimum amount of a liquid droplet discharged from the first nozzle 64A larger than the minimum amount of a liquid droplet discharged from the second nozzle 64B.

FIG. 11 indicates, in this embodiment, combinations of types of inks and driving pulses to be used for these colors. For nozzles Nz from which light-color inks having a low content percentage of pigments such as a light magenta ink, light cyan ink and light black ink and a spot-color ink such as a violet ink, a pulse selected from all of the first pulse P1, second pulse P2, and third pulse P3 is supplied. That is, for data representing light-color inks and a spot-color ink, the second dither mask 47 is used to execute half-tone processing with three values, tone values of 0, 1, and 2. For nozzles Nz from which deep-color inks having a high content percentage of pigments such as a cyan ink, magenta ink, yellow ink, and black ink, a pulse selected from the second pulse P2 and third pulse P3 is supplied. That is, for data representing deep-color inks, the first dither mask 46 is used to execute half-tone processing with two values, tone values 0 and 1.

When the second ink, that is, an ink discharged by the first amount of a liquid droplet according to the first pulse, and the first ink, that is, an ink not discharged by the first amount of a liquid droplet according to the first pulse, are to be selected from a plurality of inks, the selection correlates with the ease or difficulty with which relative granularity is affected. That is, when the ratio of the first ink is increased, the effect of reducing mist is increased but the granularity is lowered, so a tradeoff becomes important. As for two types of inks that can be used as a deep-color ink and a light-color ink, that is, a magenta ink and a light magenta ink, a cyan ink and a light cyan ink, or a black ink and a light black ink in this embodiment, for example, a light-color ink has the property of more likely to affect granularity than a deep-color ink. In view of this, light-color inks, which are, in this embodiment, a light magenta, light cyan, and light black, are preferably used as the first ink, and deep-color inks, which are, in this embodiment, a magenta ink, cyan ink, and black ink, are preferably used as the second ink. This is because since, in the gray scale region of a slightly light color, liquid droplets on the medium M are separated without being combined, a reproduced image is likely to be affected by low granularity due to enlarged liquid droplets, so light-color inks are more frequently used for reproduction in this type of gray scale region of a light color than deep-color inks. A spot-ink, which is, in this embodiment, is a violet ink, is additionally used to increase color reproducibility. To meet this purpose, there is a strong need for more precise gray scale representation. Since a spot-color ink is also used in a gray scale region, as described above, which is sensitive to granularity, it is preferable for the spot-color ink to be more preferentially used as the second ink than process color inks. When inks have high brightness and thereby are inherently less likely to affect granularity as in the case of a yellow ink, it is preferable for these inks to be used as the first ink to prioritize the effect of reducing mist.

As described above, in this embodiment, a pulse selected from the second pulse P2 and third pulse P3 is supplied to nozzles Nz from which deep-color inks having a high content percentage of pigments such as a cyan ink, magenta ink, yellow ink, and black ink. That is, for data representing deep-color inks, the first dither mask 46 is used to execute half-tone processing with two values, tone values 0 and 1. The minimum amount of a liquid droplet discharged from the first nozzle 64A from which a deep-color ink is discharged is the second amount, which is larger than the first amount. Thus, it is possible to suppress a drop in granularity and to reduce the amount of generated mist. Since it is also possible to reduce the possibility that a discharge failure occurs due to an increase in viscosity, reliability can be improved in discharging.

Of course, the selection of the first ink or second ink should be determined according to a tradeoff in properties concerning granularity and relative image quality in the ink set. When an ink set other than in this embodiment is used, therefore, control may be performed differently from this embodiment. When, for example, a light-color ink is not used as a black ink, that is, an ink set including only a deep black ink is substituted, the black ink is frequently used to reproduce a gray scale region sensitive to granularity. Therefore, when a light-color ink is not used as a black ink, control is preferably performed so that a black ink is used as the second ink, that is, as an ink discharged by the first amount of a liquid droplet according to the first pulse.

B. Preferred Aspects in the First Embodiment

B-1. Number of Nozzle Rows

In a multi-color head including many nozzle rows (for example, eight or more nozzle rows), the number of rows of second nozzles 64B, the minimum amount of a liquid droplet discharged from each second nozzle 64B being smaller than from the first nozzle 64A, is preferably 4 or smaller. That is, the number of inks discharged from the second nozzles 64B is preferably 4 or smaller. When, for example, inks used in the recording apparatus 50 include another spot-color ink besides a light magenta ink, light cyan ink, light black ink, and a violet ink, settings are made so that four inks of these inks are discharged from the second nozzles 64B. The smaller the amount of a liquid droplet from the nozzle Nz is, the larger the degree of variations in the amount of ink discharged from each nozzle row 64 is. When, for example, a difference of ±0.1 ng occurs in the weight of discharged ink in a case in which the amount of discharged ink is 5 pl, the degree of variations is ±2%. However, when a difference of ±0.1 ng occurs in the weight of discharged ink in a case in which the amount of discharged ink is 1.5 pl, the degree of variations is increased to ±7%. That is, when the number of rows of second nozzles 64B from which a small amount of ink is discharged is set to 4 or smaller, the degree of variations in the amount of discharged ink can be reduced.

B-2. Amounts of Discharge according to the First Pulse and Second Pulse

Figures 12, 13:
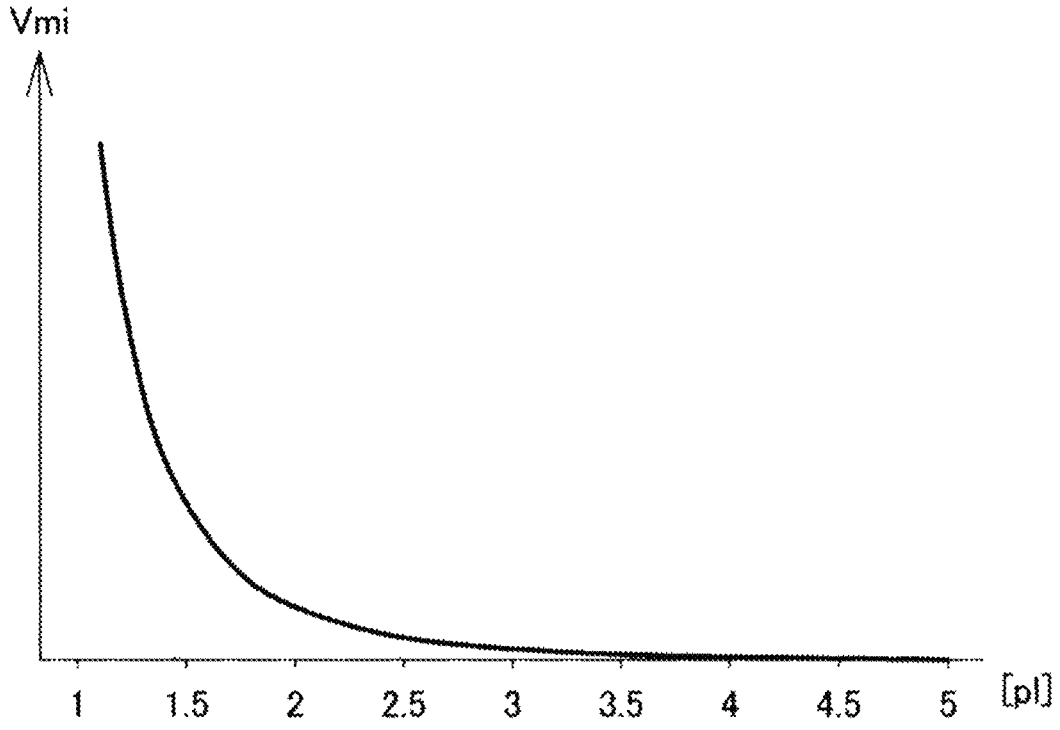
FIG. 12 is a graph illustrating a relationship between the amount of a liquid droplet discharged from a nozzle and the amount of mist.
FIG. 13 indicates pulse selection data in a second embodiment and driving pulses to be selected.

FIG. 12 is a graph illustrating a relationship between the amount of a liquid droplet discharged from the nozzle Nz and the amount Vmi of mist. The horizontal axis indicates the amount of a liquid droplet, and the vertical axis indicates the amount Vmi of generated mist. There is a relationship in which when the amount of a liquid droplet is increased to 1.2 times, the amount Vmi of generated mist is halved. In FIG. 12, this relationship is present at least in a range in which the amount of a liquid droplet is from 1.0 pl to 5.0 pl. Therefore, the minimum amount of a liquid droplet discharged from the first nozzle 64A is preferably 1.2 times or more the minimum amount of a liquid droplet discharged from the second nozzle 64B. In this case, the amount of generated mist can be reduced. The minimum amount of a liquid droplet discharged from the first nozzle 64A is also preferably less than 1.2 times the maximum amount of a liquid droplet discharged from the second nozzle 64B. In this case, it is possible to suppress a large difference between the amount of a liquid droplet discharged from the first nozzle 64A and the amount of a liquid droplet discharged from the second nozzle 64B, making it possible to suppress an extreme drop in granularity during printing.

The minimum amount of a liquid droplet discharged from the first nozzle 64A is more preferably 2.0 times or more the minimum amount of a liquid droplet discharged from the second nozzle 64B. When, for example, the minimum amount of a liquid droplet discharged from the first nozzle 64A is 2.0 pl, the minimum amount of a liquid droplet discharged from the second nozzle 64B is preferably 4.0 pl or more. In this case, since large dots and small dots formed on the medium M are clearly distinguished, the gradation of an image recorded on the medium M can be further improved.

C. Second Embodiment

In a second embodiment, the half-tone processing section 33 uses the second dither mask 47 to execute half-tone processing with three values, tone values 0, 1, and 2, regardless of the type of ink.

FIG. 13 indicates pulse selection data Dps created according to tone values in the second embodiment and the driving pulses P1 to P3 to be selected. In the second embodiment, the SP data 95 in the first embodiment is used as the first SP data 95 to create the pulse selection data Dps corresponding to second inks, which are a light cyan ink, light magenta ink, light black ink, and violet ink. That is, for the piezoelectric elements used to discharge these second inks, a driving pulse is selected from all of the first pulse P1, second pulse P2, and third pulse P3. Specifically, the recording apparatus 50 is structured so that when second recording data PD, which is recording data PD corresponding to the second nozzle 64B, that is, the recording data PD for the second inks, is a first tone value (10), the first amount of a liquid droplet is discharged from the second nozzle 64B and that when the second recording data PD is a second tone value (01), the second amount of a liquid droplet, the second amount being larger than the first amount of a liquid droplet, is discharged from the second nozzle 64B. In this embodiment, the first tone value (10) is equivalent to tone value 2 and the second tone value (01) is equivalent to tone value 1.

In this embodiment, the memory 92 in the controller 90 stores second SP data, which differs from the first SP data 95. The second SP data is used to create the pulse selection data Dps for the first inks, which are a cyan ink, magenta ink, yellow ink, and black ink. The pulse selection data Dps created by the nozzle driving circuit 98 when tone value 2 is used differs between the second SP data and the first SP data 95. When the second SP data is sent to the control driver 94, the pulse selection data Dps created in the case of tone value 2 is 010, as indicated in FIG. 13. That is, the nozzle driving circuit 98 creates the pulse selection data Dps with a value of 010, which is used to select the second pulse P2, both when the first recording data PD, which is recording data PD corresponding to the first nozzle 64A, that is, recording data PD for the first inks, is the first tone value (10) and when the first recording data PD is the second tone value (01). Thus, the recording apparatus 50 is structured so that both when the first recording data PD is the first tone value (10) and when it is the second tone value (01), the second amount of a liquid droplet is discharged, the second amount being larger than the first amount, from the first nozzle 64A.

According to the above second embodiment, an effect similar to the effect in the first embodiment is obtained for the structure similar to the structure in the first embodiment. For example, the minimum amount of a liquid droplet discharged from the first nozzle 64A is the second amount, and the minimum amount of a liquid droplet discharged from the second nozzle 64B is the first amount. The second amount is larger than the first amount. Thus, when an ink type is appropriately selected according to the nozzle, first nozzle 64A or second nozzle 64B, from which the ink is to be discharged, it is possible to suppress a drop in granularity and to reduce the amount of mist generated from liquid droplets. Also, according to the above second embodiment, when the tone value in the first recording data PD and the tone value in the second recording data PD are both the first tone value, it is possible to make the amount of a liquid droplet discharged from the first nozzle 64A larger than the amount of a liquid droplet discharged from the second nozzle 64B. Thus, it becomes easy to make the minimum amount of a liquid droplet discharged from the first nozzle 64A larger than the minimum amount of a liquid droplet discharged from the second nozzle 64B.

D. Third Embodiment

FIG. 14 indicates pulse selection data Dps created according to tone values in a third embodiment and the driving pulses P1 to P3 to be selected. In this embodiment, second SP data different from that in the second embodiment is stored in the memory 92. The pulse selection data Dps created when tone value 2 is used differs between the second SP data in this embodiment and the second SP data in the second embodiment. Other structures are similar to those in the second embodiment. The second SP data is used to create the pulse selection data Dps for the first inks, which are a cyan ink, magenta ink, yellow ink, and black ink. When the second SP data is sent to the control driver 94, the pulse selection data Dps created in the case of tone value 2 is 000. That is, when the first recording data PD, which is recording data PD corresponding to the first nozzle 64A, that is, recording data PD for the first inks, is the first tone value (10), the nozzle driving circuit 98 creates pulse selection data Dps with a value of 000, which is used to select the third pulse P3. When the first recording data PD is the second tone value (01), however, the nozzle driving circuit 98 creates pulse selection data Dps with a value of 010, which is used to select the second pulse P2. Thus, the recording apparatus 50 is structured so that when the first recording data PD is the first tone value (10), no liquid droplet is discharged from the first nozzle 64A and that when the first recording data PD is the second tone value (01), the second amount of a liquid droplet is discharged, the second amount being larger than the first amount, from the first nozzle 64A.

In the case of the second recording data PD corresponding to the second nozzle 64B, first SP data 57 is used to create the pulse selection data Dps as in the second embodiment. That is, the recording apparatus 50 is structured so that the first amount of a liquid droplet is discharged from the second nozzle 64B when the second recording data PD is the first tone value (10) and the second amount of a liquid droplet is discharged, the second amount being larger than the first amount, from the second nozzle 64B when the second recording data PD is the second tone value (01).

According to the above third embodiment, an effect similar to the effect in the first embodiment is obtained for the structure similar to the structure in the first embodiment. For example, the minimum amount of a liquid droplet discharged from the first nozzle 64A is the second amount, and the minimum amount of a liquid droplet discharged from the second nozzle 64B is the first amount. The second amount is larger than the first amount. Thus, when an ink type is appropriately selected according to the nozzle, first nozzle 64A or second nozzle 64B, from which the ink is to be discharged, it is possible to suppress a drop in granularity and to reduce the amount of mist generated from liquid droplets. Also, according to the above third embodiment, when the recording data PD includes the first tone value, no liquid droplet is discharged from the first nozzle 64A and the first amount of a liquid droplet is discharged from the second nozzle 64B. This makes it possible to easily make the minimum amount of a liquid droplet discharged from the first nozzle 64A larger than the minimum amount of a liquid droplet discharged from the second nozzle 64B.

E. Fourth Embodiment

FIG. 15 indicates driving pulses in a fourth embodiment. In the fourth embodiment, the half-tone processing section 33 uses data corresponding to the first inks, data corresponding to the second inks, and the second dither mask 47 to execute half-tone processing with three values, tone values 0, 1, and 2. In the fourth embodiment, the nozzle driving circuit 98 creates the pulse selection data Dps indicated in FIG. 6 with reference to the recording data PD and SP data 95. That is, the pulse selection data Dps can include the pulse selection data Dps (011) used to select the first pulse P1, the pulse selection data Dps (010) used to select the second pulse P2, and the pulse selection data Dps (000) used to select the third pulse P3, regardless of the type of ink.

Different applied voltages and different pulse shapes are used for pulse 1, which is a driving pulse used to discharge liquid droplets from the first nozzle 64A, from which a first ink is discharged, and pulse 2, which is a driving pulse used to discharge liquid droplets from the second nozzle 64B, from which a second ink is discharged, as indicated in FIG. 15. Specifically, pulse 1 and pulse 2 are set so that the amount of a liquid droplet discharged from the nozzle Nz in response to pulse 1 is larger than the amount of a liquid droplet discharged in response to pulse 2. Pulse 1 and pulse 2 are also set so that the amounts of liquid droplets discharged from the nozzle Nz in response to pulse 1 and pulse 2 are smaller than the amount of a liquid droplet discharged in response to pulse 3. The amount of a liquid droplet discharged from the nozzle Nz in response to pulse 2 is 2.0 pl, and the amount of a liquid droplet discharged from the nozzle Nz in response to pulse 1 is, for example, 3.0 pl. Pulse 1 and pulse 2 are each used as the first pulse P1. The amount of a liquid droplet discharged from the nozzle Nz in response to pulse 3 is, for example, 4.0 pl. Pulse 3 is used for both the nozzle Nz from which a first ink is discharged and the nozzle Nz from which a second ink is discharged. Pulse 3 is used as the second pulse P2.

According to the above fourth embodiment, liquid droplets are discharged from each of the first nozzle 64A and second nozzle 64B in two amounts, and recording is possible with the same number of tone values. Since the minimum amount of a liquid droplet of each first ink can be made smaller than in the first embodiment, when the first ink is used for recording on the medium M, granularity can be improved.

F. Other Embodiments

F-1. Another Embodiment 1

In the above embodiments, the image processing apparatus 10 and recording apparatus 50 have been separate apparatuses, but the recording apparatus 50 may include the image processing apparatus 10.

F-2. Another Embodiment 2

In the above embodiments, the nozzles Nz included in each of the nozzle rows 64C, 64M, 64Y, 64K, 64LC, 64LM, 64LK and 64VI have had the same nozzle diameter, but may have different nozzle diameters.

F-3. Another Embodiment 3

A pulse selected from all of the first pulse P1, second pulse P2, and third pulse P3 is preferably supplied even for nozzles Nz used to discharge a light black ink having a lower content percentage of pigments and a dull hue. That is, for data representing an ink with a dull hue, the second dither mask 47 is preferably used to execute half-tone processing with three values, tone values 0, 1, and 2. This improves the black concentration of an image formed on the medium M.

F-4. Another Embodiment 4

Part of a structure that has been implemented by hardware in the above embodiments may be implemented by software. Conversely, part of a structure that has been implemented by software may be implemented by hardware. When part or all of the functions in the present disclosure is implemented by software, the software, which is a computer program, can be provided by being stored in a computer-readable recording medium. In the present disclosure, computer-readable recording mediums are not limited to portable recording media such as flexible disks and compact disk-read-only memories (CD-ROMs), but include storage devices, such as various types of RAMs and ROMs, that are used in the computer as well as external storage devices, such as hard disk drives, specific to the computer. That is, the computer-readable recording medium has a broad sense; it also refers to an arbitrary recording medium that can permanently store data rather than temporary storing data.

G. Other Aspects

The present disclosure is not limited to the embodiments described above; the present disclosure can be implemented in many variations without departing from the intended scope of the present disclosure. For example, the present disclosure can be implemented in aspects below. Technical features, in the above embodiments, corresponding to technical features in the aspects described below can be appropriately replaced or combined to solve part or all of the problems in the present disclosure or achieve part or all of the effects of the present disclosure. When these technical features are not described in this specification as being essential, the technical features can be appropriately deleted.

(1) According to an aspect of the present disclosure, a recording system is provided that discharges different amounts of liquid droplets from a single nozzle to achieve multi-tone recording. This recording system has a first nozzle and a second nozzle. The minimum amount of a liquid droplet discharged from the first nozzle is larger than the minimum amount of a liquid droplet discharged from the second nozzle. According to this embodiment, when an ink type is appropriately selected according to the nozzle, first nozzle or second nozzle, from which the ink is to be discharged, it is possible to suppress a drop in granularity and reduce the amount of mist generated from liquid droplets.

(2) In the above aspect, in recording with the first nozzle and in recording with the second nozzle, the same number of tone values may be used. According to this aspect, in recording with the first nozzle and second nozzle, the same number of tone values can be used.

(3) In the above aspect, the recording system may further have a control driver that performs discharge control for the liquid droplet discharged from the first nozzle and second nozzle, according to recording data. Both when first recording data, which is the recording data corresponding to the first nozzle, indicates a first tone value and when the first recording data indicates a second tone value, the control driver may cause a second amount of the liquid droplet to be discharged from the first nozzle, the second amount being larger than a first amount. When second recording data, which is the recording data corresponding to the second nozzle, indicates the first tone value, the control driver may cause the first amount of the liquid droplet to be discharged from the second nozzle. When the second recording data indicates the second tone value, the control driver may cause the second amount of the liquid droplet to be discharged from the second nozzle. According to this aspect, when the tone values in the first recording data and second recording data are both the first tone value, the amount of the liquid droplet discharged from the first nozzle can be made larger than the amount of the liquid droplet discharged from the second nozzle. Thus, the minimum amount of the liquid droplet discharged from the first nozzle can be easily made larger than the minimum amount of the liquid droplet discharged from the second nozzle.

(4) In the above aspect, the recording system may further have a control driver that performs discharge control for the liquid droplet discharged from the first nozzle and second nozzle, according to recording data. When first recording data, which is the recording data corresponding to the first nozzle, indicates a first tone value, the control driver may cause no liquid droplet to be discharged from the first nozzle. When the first recording data indicates a second tone value, the control driver may cause a second amount of the liquid droplet to be discharged from the first nozzle, the second amount being larger than a first amount. When second recording data, which is the recording data corresponding to the second nozzle, indicates the first tone value, the control driver may cause the first amount of the liquid droplet to be discharged from the second nozzle. When the second recording data indicates the second tone value, the control driver may cause the second amount of the liquid droplet to be discharged from the second nozzle. According to this aspect, when the recording data indicates the first tone value, no liquid droplet is discharged from the first nozzle, but the first amount of the liquid droplet is discharged from the second nozzle. Thus, the minimum amount of the liquid droplet discharged from the first nozzle can be easily made larger than the minimum amount of the liquid droplet discharged from the second nozzle.

(5) In the above aspect, the first nozzle and second nozzle may have the same nozzle diameter. According to this aspect, the first nozzle and second nozzle that have the same nozzle diameter can be used to discharge liquid droplets.

(6) In the above aspect, to make the minimum amount of the liquid droplet discharged from the first nozzle larger than the minimum amount of the liquid droplet discharged from the second nozzle, different driving pulses may be used as a driving pulse for use for the first nozzle to discharge the liquid droplet from the first nozzle and a driving pulse for use for the second nozzle to discharge the liquid droplet from the second nozzle. According to this aspect, when different driving pulses are used to discharge a liquid droplet from the first nozzle and to discharge a liquid droplet from the second nozzle, the minimum amount of the liquid droplet discharged from the first nozzle can be easily made larger than the minimum amount of the liquid droplet discharged from the second nozzle.

(7) In the above aspect, when inks in one type of color are used as a first ink and a second ink having a lower ink concentration than the first ink, the first nozzle may be used to discharge the first ink and the second nozzle may be used to discharge the second ink. According to this aspect, the first ink having a high concentration is more susceptible to an increase in the viscosity of ink, the increase being caused along with the evaporation of moisture, than the second ink having a low concentration. Therefore, when the first nozzle, the minimum amount of the liquid droplet discharged from the first nozzle being large, is used to discharge the first ink susceptible to an increase in viscosity, the effect of the increase in viscosity can be reduced.

(8) In the above aspect, the ink discharged from the first nozzle may be at least any one of a cyan ink, a magenta ink, a yellow ink, and a black ink, and the ink discharged from the second nozzle may be a spot-color ink different from the cyan ink, magenta ink, yellow ink, and black ink. According to this aspect, the first nozzle and second nozzle can be selectively used to discharge liquid droplets according to the property of each of the cyan ink, magenta ink, yellow ink, black ink, and spot-color ink.

(9) In the above aspect, the ink discharged from the first nozzle may be less likely to affect granularity during recording than the ink discharged from the second nozzle. According to this aspect, it is possible to suppress a drop in the granularity of an image formed on the medium M.

(10) In the above aspect, the minimum amount of the liquid droplet discharged from the first nozzle may be 1.2 times or more the minimum amount of the liquid droplet discharged from the second nozzle, and may be less than 1.2 times the maximum amount of the liquid droplet discharged from the second nozzle. According to this aspect, it is possible to reduce the amount of mist generated from liquid droplets and to suppress an extreme drop in granularity.

The present disclosure can also be implemented in various forms besides a recording system. For example, the present disclosure can be implemented as a method of controlling a recording system or a program that executes the control method.

What is claimed is:

1. A recording system recording a multi-tone image with liquid droplets of different amount discharged from nozzles, the system comprising:

a first nozzle and a second nozzle, wherein a minimum amount of a liquid droplet discharged from the first nozzle is larger than a minimum amount of a liquid droplet discharged from the second nozzle, and wherein the minimum amount of the liquid droplet discharged from the first nozzle is 1.2 times or more the minimum amount of the liquid droplet discharged from the second nozzle, and is less than 1.2 times the maximum amount of the liquid droplet discharged from the second nozzle.

2. The recording system according to claim 1, wherein in recording with the first nozzle and in recording with the second nozzle, the same number of tone values is used.

3. The recording system according to claim 1, wherein the first nozzle and second nozzle have the same nozzle diameter.

4. The recording system according to claim 1, wherein a driving pulse for use for the first nozzle to discharge the liquid droplet from the first nozzle is different from a driving pulse for use for the second nozzle to discharge the liquid droplet from the second nozzle.

5. The recording system according to claim 1, wherein the first nozzle is used to discharge a first ink, and the second nozzle is used to discharge a second ink, and the second ink has a lower ink concentration than the first ink.

6. The recording system according to claim 1, wherein:

the ink discharged from the first nozzle is at least any one of a cyan ink, a magenta ink, a yellow ink, and a black ink; and the ink discharged from the second nozzle is a spot-color ink different from the cyan ink, magenta ink, yellow ink, and black ink.

7. The recording system according to claim 1, wherein the ink discharged from the first nozzle is less likely to affect granularity during recording than the ink discharged from the second nozzle.

8. A recording system recording a multi-tone image with liquid droplets of different amounts discharged from nozzles, the system comprising:

a first nozzle and a second nozzle; and a control driver configured to control discharge of the liquid droplets from the first nozzle and second nozzle, according to a recording data, wherein:

a minimum amount of a liquid droplet discharged from the first nozzle is larger than a minimum amount of a liquid droplet discharged from the second nozzle;

both when a first recording data, which is the recording data corresponding to the first nozzle, indicates a first tone value and when the first recording data indicates a second tone value, the control driver causes a second amount of the liquid droplet to be discharged from the first nozzle, the second amount being larger than a first amount; and when a second recording data, which is the recording data corresponding to the second nozzle, indicates the first tone value, the control driver causes the first amount of the liquid droplet to be discharged from the second nozzle, and when the second recording data indicates the second tone value, the control driver causes the second amount of the liquid droplet to be discharged from the second nozzle.

9. A recording system recording a multi-tone image with liquid droplets of different amounts discharged from nozzles, the system comprising:

a first nozzle and a second nozzle; and a control driver configured to control discharge of the liquid droplets from the first nozzle and second nozzle, according to a recording data, wherein:

a minimum amount of a liquid droplet discharged from the first nozzle is larger than a minimum amount of a liquid droplet discharged from the second nozzle;

when a first recording data, which is the recording data corresponding to the first nozzle, indicates a first tone value, the control driver causes no liquid droplet to be discharged from the first nozzle, and when the first recording data indicates a second tone value, the control driver causes a second amount of the liquid droplet to be discharged from the first nozzle, the second amount being larger than a first amount; and when a second recording data, which is the recording data corresponding to the second nozzle, indicates the first tone value, the control driver causes the first amount of the liquid droplet to be discharged from the second nozzle, and when the second recording data indicates the second tone value, the control driver causes the second amount of the liquid droplet to be discharged from the second nozzle.

* * * * *